US008076253B2

(12) United States Patent
Sakai et al.

(10) Patent No.: US 8,076,253 B2
(45) Date of Patent: Dec. 13, 2011

(54) OPAL-FINISHED FABRIC

(75) Inventors: Masahiko Sakai, Fukui (JP); Takuya Suehiro, Fukui (JP); Katsuhiko Yanagi, Fukui (JP)

(73) Assignee: Seiren Co., Ltd., Fukui (JP)

( * ) Notice: Subject to any disclaimer, the term of this patent is extended or adjusted under 35 U.S.C. 154(b) by 588 days.

(21) Appl. No.: 12/084,097

(22) PCT Filed: Oct. 26, 2006

(86) PCT No.: PCT/JP2006/321400

§ 371 (c)(1),
(2), (4) Date: Apr. 24, 2008

(87) PCT Pub. No.: WO2007/049710

PCT Pub. Date: May 3, 2007

(65) Prior Publication Data

US 2009/0263636 A1 Oct. 22, 2009

(30) Foreign Application Priority Data

Oct. 27, 2005 (JP) ..... 2005-313067

(51) Int. Cl.
*D03D 15/00* (2006.01)

(52) U.S. Cl. ..... 442/189; 8/115.54

(58) Field of Classification Search ..... None
See application file for complete search history.

(56) References Cited

FOREIGN PATENT DOCUMENTS

| | | |
|---|---|---|
| JP | 48-64268 | 9/1973 |
| JP | 61-28091 | 2/1986 |
| JP | 1-266288 | 10/1989 |
| JP | 4-263679 | 9/1992 |
| JP | 5-98587 | 4/1993 |
| JP | 2000-96439 | 1/2000 |
| JP | 2000-119976 | 4/2000 |
| JP | 2000-282362 | 10/2000 |
| JP | 2005-82907 | 3/2005 |
| JP | 2006-219809 | 8/2006 |

OTHER PUBLICATIONS

Morooka Harumi, et al. Effect of Opal Processing on Thermal Comfort of Sportswear, Thermophys Prop, vol. 27, Abstract Only, 2006.*

* cited by examiner

*Primary Examiner* — Jenna Johnson
(74) *Attorney, Agent, or Firm* — Jordan and Hamburg LLP

(57) ABSTRACT

An opal-finished fabric having a stereoscopic pattern is provided, in which both the fiber-decomposed part and the non-decomposed fiber part are rich in color expression, and the fiber-decomposed part having a sufficient strength with a thin material having highly transparent appearance in the fiber-decomposed part. The fabric is an opal-finished fabric obtained with two or more kinds of fibers and formed with a fiber-decomposed part showing a transparent appearance by removing at least one kind of the fibers and a non-decomposed fiber part, in which for solving the problems, the fiber-decomposed part contains mainly nylon fibers, and the non-decomposed fiber part contains mainly colored polyester fibers and non-colored nylon fibers. The non-decomposed fiber part is preferably constituted by a layer containing mainly polyester fibers and a layer containing mainly nylon fibers. The stretchability thereof can be improved by using the fabric further containing polyurethane fibers or weaving the fiber-decomposed part with an atlas stitch structure or a two-needle stitch structure.

8 Claims, 1 Drawing Sheet

OPAL-FINISHED FABRIC

TECHNICAL FIELD

The present invention relates to an opal-finished fabric containing mainly nylon fibers and polyester fibers and having been subjected to a fiber-decomposing treatment.

BACKGROUND ART

Highly designed fabrics have been developed with various techniques in recent years, and are being spread over fields of sports, fashion and underwear. Among the highly designed fabrics, fabrics having a stereoscopic pattern formed thereon are receiving attention. Furthermore, a fabric having not only stereoscopic appearance but also a fine pattern with clear color is being demanded.

Examples of a fabric having a stereoscopic pattern formed thereon include a fabric subjected to a fiber-decomposition printing method and a fabric having embroidery. As an example of the former, a so-called opal-finished fabric has been known, in which a cross woven fabric or a blended fabric of synthetic fibers, such as polyester, nylon or the like, and vegetable fibers, such as silk, rayon or the like, is printed with a carbonizing paste using sulfuric acid, aluminum sulfate or the like, or a strongly alkaline fiber-decomposing paste, whereby at least one kind of the fibers constituting the fabric is removed in the printed part to form a see-through pattern. However, such a conventional opal-finished fabric is difficult to provide that has a large number of colors with a complex pattern or has clear color tones in patterns, in both the fiber-decomposed part and the non-decomposed fiber part, and thus the pattern applied thereto disadvantageously suffers large restriction in design. This is because as follows. As the ordinary method for dyeing a fiber-decomposed part in the opal-finishing, the fabric is dyed with an alkali-undecomposable dye for ground dyeing before or after the fiber-decomposing treatment, so as to dye only fibers that are not to be decomposed or to dye the entire fibers constituting the fabric, and thus the fibers of only one kind or the entire fibers in the non-decomposed fiber part (land part) are dyed. Accordingly, even in the case where a multi-color pattern is printed on the non-decomposed fiber part in a separate step, expression of the colors of the pattern is affected by the ground dye color, and thus it is difficult to obtain clear colors as in the case where the pattern is printed on a white fabric.

As a method for dyeing the fiber-decomposed part without ground dyeing for preventing the pattern applied to the non-decomposed fiber part from suffering influence of the ground dye color, Patent Documents 1 and 2 propose such methods in that a dye is added in advance to the carbonizing paste or the fiber-decomposing paste, so as to dye directly the fibers in the fiber-decomposed part. However, the methods involve such various restrictions as that the dye to be selected is resistant to the carbonizing paste or the fiber-decomposing paste, and the dyes of three primary colors for mixed color have equivalent dyeing speeds, which complicate provision of stable color tone. Furthermore, the color printed on the fiber-decomposed part is practically restricted to only monochrome since the boundary between the pastes is difficult to control upon printing different fiber-decomposing pastes on one fabric, and thus expression of patterns is significantly restricted.

On the other hand, there has been such a fabric that is obtained by dyeing a thin fabric, such as a power net material and the like, by dip dyeing or printing, and then applying a stereoscopic pattern, such as embroidery or the like, as post processing. The fabric is rich in design since the depressed part can be freely dyed clearly and the land part can have certainly free expression, but the fabric involves the following problems in production cost and productivity. Production of the fabric requires separate steps including the dyeing step and the embroidery step, whereby the positioning of the patterns on the depressed part and the land part becomes complicated, and the colors constituting the pattern are determined by the threads, which necessitates on-demand thread change for increasing the number of colors. Furthermore, the fabric involves such a problem in that an unnecessary depression line is formed for connecting the depressed parts upon expressing the land part. Moreover, the consumer may experience discomfort with the embroidery part depending on the purpose of the product (such as a purpose where the fabric is in direct contact with the skin, for example, an underwear), and thus the fabric cannot be applied to wide variation of fields.

There are some cases where a fabric having a fiber-decomposed pattern for clothing products is demanded to have a transparent appearance in the fiber-decomposed part to express a highly stereoscopic appearance in the other part (non-decomposed fiber part). Upon expressing the transparent appearance on the fabric, however, there are such problems in that the structure remaining on the part having been subjected to the fiber-decomposing treatment (fiber-decomposed part) is liable to suffer decrease in strength, particularly tearing strength, and the woven texture may be displaced or raveled out.

Patent Document 1: JP-A-2000-96439

Patent Document 2: JP-A-5-98587

SUMMARY OF THE INVENTION

The invention has been made under the aforementioned circumstances, and an object thereof is to provide such an opal-finished fabric that is capable of expressing a pattern rich in stereoscopic appearance. In particular, an object thereof is to provide such an opal-finished fabric that is rich in color expression, such as a complex pattern with large number of colors, a pattern with clear colors, and the like, on both the fiber-decomposed part and the non-decomposed fiber part. Furthermore, an object thereof is to provide such an opal-finished fabric that has a sufficient strength in the fiber-decomposed part of a thin material having highly transparent appearance in the fiber-decomposed part. In the specification, the terms "stereoscopic appearance", "stereoscopic", "stereoscopic pattern" and the like include not only irregularities that are actually formed, but also a stereoscopic appearance that is recognized only visually.

An opal-finished fabric, as illustrated with reference to the drawing FIG. 1, is obtained with two or more kinds of fibers and formed with a fiber-decomposed part A showing a transparent appearance by removing at least one kind of the fibers and a non-decomposed fiber part B, in which for solving the problems, the fiber-decomposed part contains mainly nylon fibers 1, and the non-decomposed fiber part contains mainly colored polyester fibers 2 and nylon fibers 1, including non-colored nylon fibers.

In the fabric, the fiber-decomposed part may contain mainly colored nylon fibers.

The term "colored" herein means cases where most of the area (70% or more) is colored, and includes cases where a non-colored area is present. Cases where a pattern is applied are also included.

It is preferred that the non-decomposed fiber part is constituted by a layer containing mainly polyester fibers and a layer containing mainly nylon fibers.

In the invention, the fabric may further contain polyurethane fibers.

In this case, it is preferred that the non-fiber-decomposed part is constituted by a layer containing mainly polyester fibers and a layer containing mainly nylon fibers and polyurethane fibers.

It is preferred in the invention that the fiber-decomposed part is woven with an atlas stitch structure or a two-needle stitch structure.

It is preferred in the invention that the layer containing mainly polyester fibers of the non-fiber-decomposed part has a pattern applied on at least a surface thereof.

According to the invention, the color expression on the non-fiber-decomposed part is not affected by the color expression on the fiber-decomposed part, and the color expression on the fiber-decomposed part is not restricted to monochrome, whereby such an opal-finished fabric can be provided that has a stereoscopic pattern rich in color variation on both the non-decomposed fiber part and the fiber-decomposed part. Furthermore, such an opal-finished fabric can be provided that has a sufficient strength on the fiber-decomposed part.

BRIEF DESCRIPTION OF THE DRAWING

A schematic illustration showing aspects of the construction of the opal-finished fabric of the invention.

DETAILED DESCRIPTION OF THE INVENTION

Figure 1:
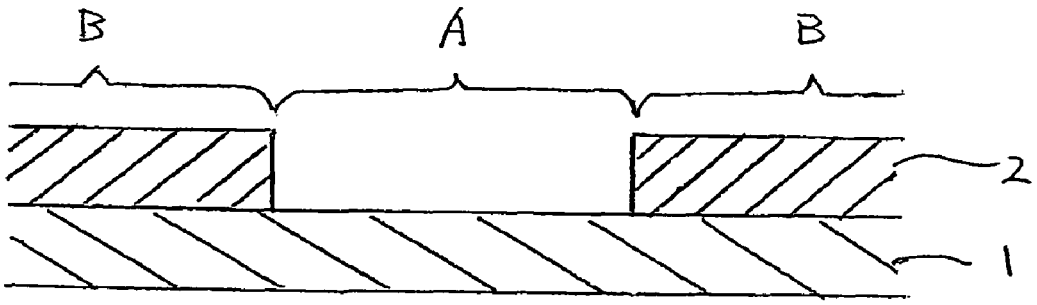

The nylon fibers used in the invention may be 6-nylon fibers, 66-nylon fibers or the like. Among these, 66-nylon fibers are preferred in the case where high strength is required as in sports clothing and the like.

The polyester fibers (which is hereinafter abbreviated as PET fibers in some cases) used in the invention include polyester fibers formed of polyethylene terephthalate or the like, and cation dyeable polyester fibers of a normal pressure type and a high pressure type. Among these, cation dyeable polyester fibers of a high pressure type are preferred since they are excellent in color reproducibility and color fastness.

The polyester fibers (which is hereinafter abbreviated as PET fibers in some cases) used in the invention include polyester fibers formed of polyethylene terephthalate or the like, and cation dyeable polyester fibers of a normal pressure type and a high pressure type. Among these, cation dyeable polyester fibers of a high pressure type are preferred since they are excellent in color reproducibility and fastness of dyed color.

The monofilament fineness of the nylon fibers is preferably 4 dtex or less, and more preferably 3 dtex or less. The lower limit thereof is preferably 1 dtex or more. In the case where the monofilament fineness exceeds 4 dtex, the fabric has stiff drape, thereby arising such a possibility in that unevenness and failure may occur in decomposition of the PET fibers. The total fineness thereof is 110 dtex or less, and preferably 78 dtex or less. The lower limit thereof is preferably 11 dtex or more, and more preferably 33 dtex or more. In the case where total fineness exceeds 110 dtex, the thickness of the fabric is increased, which affects decomposition of the PET fibers as similar to the above.

The monofilament fineness of the PET fibers is 3 dtex or less, and preferably 2 dtex or less. The lower limit thereof is preferably 0.1 dtex or more, and more preferably 0.7 dtex or more. In the case where the monofilament fineness exceeds 3 dtex, there are cases where the fibers cannot be completely decomposed and removed, which brings about visual, tactile or functional problems. The total fineness is 170 dtex or less, and preferably 110 dtex or less. The lower limit thereof is preferably 22 dtex or more, and more preferably 56 dtex or more. In the case where the total fineness exceeds 170 dtex, the thickness of the fabric is increased, which affects decomposition of the PET fibers as similar to the above.

In the fabric used in the invention, it is preferred that the nylon fibers are from 20 to 75% by weight, and the PET fibers are from 25 to 80% by weight, and it is more preferred that the nylon fibers are from 30 to 70% by weight, and the PET fibers are from 30 to 70% by weight. In the case where the nylon fibers exceed 75% by weight, i.e., the PET fibers are less than 25% by weight, the stereoscopic pattern cannot be clearly expressed, and in the case where the nylon fibers are less than 20% by weight, i.e., the PET fibers exceed 80% by weight, the fabric is difficult to maintain the form thereof.

The nylon fibers and the polyester fibers are preferably used after processing to a Taslan yarn or a covering yarn. According to the processing, the fabric can be applied with variation and can be used for various purposes.

The nylon fibers and the polyester fibers used in the invention can be combined by such methods as blended spinning, blended weaving, combined twisting, combine weaving, combined knitting or the like.

In the invention, polyurethane fibers may be used in addition to the nylon fibers and the polyester fibers, whereby the fabric can be applied with stretchability.

The polyurethane fibers used in the invention are known polyurethane fibers, which are roughly classified into ether polyurethane and ester polyurethane but are not particularly limited. Specific examples thereof include "Espa", a trade name, produced by Toyobo Co., Ltd., "Lycra", a trade name, produced by Du Pont-Toray Co., Ltd., "Roica", a trade name, produced by Asahi Kasei Corp., and the like.

The fineness of the polyurethane fibers is preferably from 10 to 150 dtex, and more preferably from 20 to 80 dtex. In the case where it is less than 10 dtex, sufficient stretchability is difficult to obtain, and in the case where it exceeds 150 dtex, there is such a tendency that the fabric has too stiff drape.

In the case where the polyurethane fibers are used, the proportion thereof in the fabric is preferably from 5 to 50% by weight, and more preferably from 5 to 40% by weight. In the case where it is less than 5% by weight, sufficient stretchability is difficult to obtain, and in the case where it exceeds 50% by weight, the fabric is deteriorated in dimensional stability and is difficult to work.

Examples of the structure of the fabric include a knitted material, a woven material, a nonwoven fabric and the like, and are not particularly limited. Examples of the woven material include a plain fabric, a twilled fabric, a sateen fabric and the like. Examples of the knitted material include a weft knit, such as a plain knit, a ribbed knit, a purl stitch and the like, and a warp knit, such as a tricot knit, cord stitch, atlas stitch and the like.

Among these, a reversible fabric constituted mainly by the decomposable fibers on one side of the fabric and mainly by the undecomposable fibers on the other side of the fabric is preferred since a stereoscopic pattern rich in variation can be formed. In other words, it is a fabric constituted by a layer formed of fibers that are substantially decomposed and a layer formed of fibers that are substantially not decomposed. Examples of the method for producing the fabric include a plating method (which may also be referred to as plated stitch).

For further improving the strength of the fiber-decomposed part, the woven structure of the fiber-decomposed part is preferably constituted by atlas stitch or two-needle stitch.

According to the structure, the fiber-decomposed part can maintain such a sufficient tear strength as 300 N or more with a thin fabric.

The form of the base fabric is preferably a raised fabric owing to the favorable texture thereof. The raised fabric herein is such a fabric that has a base structure constituted by a woven or knitted fabric or a nonwoven fabric, and raised fibers planted thereon. The raised fabric are also referred to as pile, and thus the fabric is referred to as a piled fabric.

The opal-finished fabric of the invention is not particularly limited in production process thereof, and can be produced by the following process.

A fiber-decomposing agent is applied to an area of the fabric where the fiber-decomposed area is to be formed for providing a stereoscopic pattern. Furthermore, a nylon fiber coloring dye is applied to the fiber-decomposed part for expressing a colored pattern. A polyester fiber coloring dye is applied to an area that is not fiber-decomposed where only the polyester fibers are colored.

Examples of the fiber-decomposing agent used for forming the fiber-decomposed part include a guanidine weak acid salt, a phenol compound, an alcohol compound, an alkali metal hydroxide, an alkaline earth metal hydroxide and the like. Among these, a guanidine weak acid salt is preferred since it provides a large irregularity effect and is excellent in environments and safety. Further among these, guanidine carbonate is particularly preferred since guanidine carbonate has low pH of from 10 to 13 in an aqueous solution as compared to other strong alkalis, such as sodium hydroxide, which provides safety on operation and prevention of corrosion of equipments, and upon coloring the fibers, guanidine carbonate exhibits less influence on the colorant used. It is expected that the polyester fibers are decomposed with guanidine carbonate by such a mechanism that guanidine carbonate is converted to a strong alkali by decomposing into urea and ammonia in the heat treating step carried out after applying guanidine carbonate.

The applied amount of the fiber-decomposing agent is preferably in a range of from 1 to 50 g/m$^2$, and more preferably from 5 to 30 g/m$^2$. In the case where the applied amount is less than 1 g/m$^2$, there is such a tendency that a sufficient fiber-decomposing effect cannot be obtained, and in the case where it exceeds 50 g/m$^2$, on the other hand, there is such a tendency that the amount become unnecessarily large to provide increase in cost.

Examples of the polyester fiber coloring agent include a disperse dye and a pigment, and a disperse dye excellent in fastness, clearness and coloring property may be preferably used.

As the nylon fiber coloring agent, a metal complex dye or a reactive dye can be used. As the metal complex dye, one excellent in fastness, clearness and coloring property can be used. As the kind of the reactive dye, such a reactive dye is preferred that has at least one reactive group of at least one kind selected from a monochlorotriazine group, a monofluorotriazine group, a difluoromonochloropyrimidine group, a trichloropyrimidine group and the like. Reactive dyes having the other reactive groups are liable to cause hydrolysis in an alkali atmosphere, and in the case where it is mixed on a fabric containing the fiber-decomposing agent, there is high possibility that the reactive group is decomposed to lower the coloring density to the nylon fibers.

The nylon fibers are generally dyed with an acidic dye, but an acidic dye, if used in the invention, is strongly influenced by the alkali component in the fiber-decomposing agent, thereby decreasing the coloring property and the fastness.

Examples of the method for applying the fiber-decomposing agent and the coloring agent to the fabric include an ink jet method, a screen printing method, a rotary printing method and the like, and an ink-jet method is preferably used since various fine multi-color patterns can be easily expressed.

As the kind of the ink-jet method, a continuous method, such as a charge modulation method, a charge ejection method, a microdot method, an ink mist method and the like, an on-demand method, such as a piezo conversion method, a static attraction method, and the like may be employed, and a piezo method is preferred since it is excellent in stability of ink ejection amount and in continuous ejection property and can be produced at relatively low cost.

Upon applying the fiber-decomposing agent and the coloring agent to the fabric by the ink-jet method, a step of forming an ink receiving layer on the fabric is preferably provided before the applying step. According to the procedure, the ink receiving layer thus provided receives instantaneously the fiber-decomposing ink ejected from a nozzle and retains it moderately, whereby the fiber-decomposing ink can be prevented from suffering blur.

The ink receiving layer is formed with an ink receiving agent mainly containing a water-soluble polymer. Examples of the water-soluble polymer include sodium alginate, methyl cellulose, hydroxymethyl cellulose, carboxymethyl cellulose, starch, guar gum, polyvinyl alcohol, polyacrylic acid and the like. These may be used as a combination of two or more kinds of them. Among these, carboxymethyl cellulose, which is excellent in alkali resistance and excellent in cost and flowability, is preferred. The ink receiving layer may contain known additives, such as a reduction preventing agent, a surfactant, an antiseptic, a light fastness improving agent, a deep dyeing agent and the like.

The ink receiving agent is preferably applied in an amount of from 1 to 20 g/m$^2$, and more preferably from 2 to 10 g/m$^2$, in terms of solid content. In the case where the applied amount is less than 1 g/m$^2$, there is such a tendency that the ink suffers blur or print through due to the insufficient ink receiving capability, and in the case where it exceeds 20 g/m$^2$, the fabric becomes stiff to provide such a tendency that the fabric suffers failure on conveying in an ink-jet printer, and the receiving agent is dropped off from the fabric on handling.

The applying method therefor includes a dip-nip method, a rotary screen method, a knife coater method, a kiss roll coater method, a gravure roll coater method and the like. Among these, a dip-nip method is preferred since the ink receiving layer can be formed not only on the surface of the fabric, but also on the entire fabric, so as to provide a fabric excellent in ink receiving capability.

After applying the fiber-decomposing agent and the coloring agent to the fabric, it is preferred to treat the fabric at a temperature of from 150 to 190° C. for about 10 minutes. In the case where the temperature is lower than 150° C., there is such a tendency that the polyester fibers are insufficiently decomposed, and there is also such a tendency that the polyester fibers are insufficiently colored. In the case where the temperature exceeds 190° C., the nylon fibers are insufficiently colored, and such a phenomenon may occur in that the fibers are yellowed by scorching. The heat treatment may be either a dry heat treatment or a wet heat treatment. Among these, a treatment with heat and humidity is preferred upon effecting the coloring simultaneously since favorable coloring property can be obtained simultaneously. Thereafter, a known rinsing step is carried out to provide the opal-finished fabric of the invention.

EXAMPLES

The invention will be described specifically with reference to examples of the invention and comparative examples below, but the invention is not limited to the following examples. The percentages in the examples and the comparative examples mean percentages by weight.

Example 1

(Production of Fabric A)

A composite fabric A (thickness: 1 mm) containing 43.0% by weight of nylon fibers and 57.0% by weight of PET fibers was obtained with a warp knitted reversible (tricot half) structure by using 6-nylon fibers (produced by Toray Industries, Inc., monofilament fineness: 3.7 dtex, 22 dtex/6f) and cation dyeable polyester fibers of a high pressure type (produced by Toray Industries, Inc., monofilament fineness: 0.7 dtex, 33 dtex/48f). The resulting fabric was formed of the PET fibers on one side and formed mainly of the nylon fibers on the other side, and the application of ink described later was carried out on the side formed of the PET fibers.

A treating liquid 1 obtained by mixing the following composition, followed by agitating with a homogenizer for 1 hour, was applied to the resulting composite fabric A to 2 g/m$^2$ in terms of solid content by a dip-nip method, and then dried at 170° C. for 2 minutes, to obtain a composite fabric having an ink receiving layer formed.

(Treating Liquid 1)

| | |
|---|---|
| DKS Finegum HEL-1 (produced by Dai-ichi Kogyo Seiyaku Co., Ltd., etherified carboxymethyl cellulose) | 2% |
| MS Liquid (produced by Meisei Chemical Works, Ltd., nitrobenzene sulfonate, reduction preventing agent, active ingredient: 30%) | 5% |
| Water | 93% |

(Preparation of Fiber-Decomposing Ink)

The following composition was mixed and agitated with a stirrer for 1 hour, and filtered under vacuum with ADVANTEC high-purity filter paper No. 5A (produced by Toyo Roshi Kaisha, Ltd.), followed by subjecting vacuum deaeration, to obtain a fiber-decomposing ink.

(Fiber-Decomposing Ink)

| | |
|---|---|
| Guanidine carbonate (fiber-decomposing agent) | 20% |
| Urea (solubilization stabilizer) | 5% |
| Diethylene glycol (dry preventing agent) | 5% |
| Water | 70% |

(Preparation of Pet Fiber Coloring Three Primary Colors Ink Set I)

The following compositions were mixed and agitated with a homogenizer for 1 hour, and filtered under vacuum with ADVANTEC high-purity filter paper No. 5A (produced by Toyo Roshi Kaisha, Ltd.), followed by subjecting vacuum deaeration, to obtain a PET fiber coloring three primary colors ink set I.

(Pet Fiber Coloring Three Primary Colors Ink Set I)

(Blue Ink)

| | |
|---|---|
| Kiwalon Polyester Blue BGF (produced by Kiwa Chemical Industry Co., Ltd., disperse dye, C.I. Disperse Blue 73) | 10% |
| Disper TL (produced by Meisei Chemical Works, Ltd., anionic surfactant) | 2% |
| Diethylene glycol | 5% |
| Water | 83% |

(Red Ink)

| | |
|---|---|
| Kiwalon Polyester Red BFL (produced by Kiwa Chemical Industry Co., Ltd., disperse dye, C.I. Disperse Red 92) | 10% |
| Disper TL | 2% |
| Diethylene glycol | 5% |
| Water | 83% |

(Yellow Ink)

| | |
|---|---|
| Kiwalon Polyester Yellow 6GF (produced by Kiwa Chemical Industry Co., Ltd., disperse dye, C.I. Disperse Yellow 114) | 10% |
| Disper TL | 2% |
| Diethylene glycol | 5% |
| Water | 83% |

(Preparation of Nylon Fiber Coloring Three Primary Colors Ink Set II)

The following compositions were mixed and agitated with a stirrer for 1 hour, and filtered under vacuum with ADVANTEC high-purity filter paper No. 5A (produced by Toyo Roshi Kaisha, Ltd.), followed by subjecting vacuum deaeration, to obtain a nylon fiber coloring three primary colors ink set II.

(Nylon Fiber Coloring Three Primary Colors Ink Set II)

(Blue Ink)

| | |
|---|---|
| Cibacron Blue P-3R liq. 40% (produced by Ciba SC, Inc., C.I. Reactive Blue 49, monochlorotriazine type reactive dye) | 40% |
| Urea (solubilization stabilizer) | 5% |
| Water | 55% |

(Red Ink)

| | |
|---|---|
| Kayacion Red P-4BN liq. 33% (produced by Nippon Kayaku Co., Ltd., C.I. Reactive Red 3:1, monochlorotriazine type reactive dye) | 50% |
| Urea | 5% |
| Water | 45% |

(Yellow Ink)

| | |
|---|---|
| Cibacron Yellow P-6GS liq. 33% (produced by Ciba SC, Inc., C.I. Reactive Yellow 95, monochlorotriazine type reactive dye) | 50% |
| Urea | 5% |
| Water | 45% |

The fiber-decomposing ink and the ink sets I and II were printed on the fabric A by an ink jet method. The fiber-decomposing treatment with the fiber-decomposing ink, the coloring and fiber-decomposing treatment with the fiber-decomposing ink and the ink set II, and the coloring treatment of the PET fibers with the ink set I were carried out in the printed parts.

The ink jet printing conditions were as follows. A pattern containing gradation and thin lines was formed on the colored part.

(Ink-Jet Printing Conditions)

Printing device: on-demand serial scanning ink-jet printing device

Nozzle diameter: 50 mm

Driving voltage: 100 V

Frequency: 5 kHz

Resolution: 360 dpi

Printed amount in each part:

(1) Fiber-decomposed part

Fiber-decomposing ink: 40 g/m$^2$ (2) Fiber-decomposing and pattern colored part Fiber-decomposing ink: 40 g/m$^2$ Nylon fiber coloring three primary colors ink set II: 1 to 15 g/m$^2$ for each color (3) PET fiber pattern colored part PET fiber coloring three primary colors ink set I: 1 to 15 g/m$^2$ for each color The fabric was dried and then treated with heat and humidity at 175° C. for 10 minutes by using an HT steamer. The fabric was rinsed in a soaping bath containing 2 g/L of Tripole TK (produced by Dai-ichi Kogyo Seiyaku Co., Ltd., nonionic surfactant) and 2 g/L of soda ash at 50° C. for 10 minutes. Thereafter, the fabric was treated with a fixing bath containing 2 g/L of Sunlife E-48 (produced by Nicca Chemical Co., Ltd., anionic fixing agent) at 50° C. for 10 minutes and then dried to obtain a printed matter.

Example 2

A printed matter was obtained in the same manner as in Example 1 except that the fabric A was changed to a fabric B.

(Production of Fabric B)

A composite fabric B (thickness: 2 mm) containing 40.0% by weight of nylon fibers, 40.0% by weight of PET fibers and 20.0% by weight of polyurethane fibers was obtained with a warp knitted reversible structure having a dembigh stitch structure for the nylon fibers, a code structure for the PET fibers and an atlas stitch structure for the polyurethane fibers by using 6-nylon fibers (produced by Toray Industries, Inc., monofilament fineness: 3.7 dtex, 22 dtex/6f), cation dyeable polyester fibers of a high pressure type (produced by Toray Industries, Inc., monofilament fineness: 0.7 dtex, 33 dtex/48f) and polyurethane fibers (produced by Toyobo Co., Ltd., Espa T-71, fineness: 44 dtex). The resulting fabric was formed of the PET fibers on one side and formed mainly of the nylon fibers and the polyurethane fibers on the other side, and the application of ink described later was carried out on the side formed of the PET fibers.

Example 3

A printed matter was obtained in the same manner as in Example 1 except that the fabric A was changed to a fabric C.

(Production of Fabric C)

A composite fabric C (thickness: 1 mm) containing 43.0% by weight of nylon fibers and 57.0% by weight of PET fibers was obtained with a warp knitted reversible structure having a two-needle stitch structure for the nylon fibers and a code structure for the PET fibers by using 6-nylon fibers (produced by Toray Industries, Inc., monofilament fineness: 3.7 dtex, 22 dtex/6f) and cation dyeable polyester fibers of a high pressure type (produced by Toray Industries, Inc., monofilament fineness: 0.7 dtex, 33 dtex/48f). The resulting fabric was formed of the PET fibers on one side and formed mainly of the nylon fibers on the other side, and the application of ink described later was carried out on the side formed of the PET fibers.

Example 4

A printed matter was obtained in the same manner as in Example 1 except that the fabric A was changed to a fabric D.

(Production of Fabric D)

A composite fabric D (thickness: 1 mm) containing 43.0% by weight of nylon fibers and 57.0% by weight of PET fibers was obtained with a warp knitted reversible structure having an atlas stitch structure for the nylon fibers and a code structure for the PET fibers by using 6-nylon fibers (produced by Toray Industries, Inc., monofilament fineness: 3.7 dtex, 22 dtex/6f) and cation dyeable polyester fibers of a high pressure type (produced by Toray Industries, Inc., monofilament fineness: 0.7 dtex, 33 dtex/480. The resulting fabric was formed of the PET fibers on one side and formed mainly of the nylon fibers on the other side, and the application of ink described later was carried out on the side formed of the PET fibers.

Comparative Example 1

The fabric A was treated in a bath containing 1.0% of Kayacion Red P-4BN liq. 33% at 100° C. for 15 minutes for ground dyeing. Thereafter, the treating liquid 1 was applied to the resulting fabric to 2 g/m$^2$ in terms of solid content by a dip-nip method, and then dried at 170° C. for 2 minutes, to obtain a composite fabric having an ink receiving layer formed. Thereafter, the fiber-decomposing ink and the ink set I were printed by an ink-jet method as similar to Example 1. The fabric was dried and then treated with heat and humidity at 175° C. for 10 minutes by using an HT steamer. The fabric was rinsed in a soaping bath containing 2 g/L of Tripole TK and 2 g/L of soda ash at 50° C. for 10 minutes. Thereafter, the fabric was treated with a fixing bath containing 2 g/L of Sunlife E-48 (produced by Nicca Chemical Co., Ltd., anionic fixing agent) at 50° C. for 10 minutes and then dried to obtain a printed matter.

The fiber-decomposing treatment with the fiber-decomposing ink and the coloring treatment of the PET fibers with the ink set I were carried out in the printed parts.

Comparative Example 2

Treating liquids 2 and 3 obtained by mixing the following compositions, followed by agitating with a homogenizer for 1 hour, was applied to the fabric A to 4 g/m$^2$ in terms of solid content by a rotary method. The fabric was dried and then treated with heat and humidity at 175° C. for 10 minutes by using an HT steamer. The fabric was rinsed in a soaping bath containing 2 g/L, of Tripole TK and 2 g/L of soda ash at 50° C. for 10 minutes. Thereafter, the fabric was treated with a fixing bath containing 2 g/L of Sunlife E-48 (produced by Nicca Chemical Co., Ltd., anionic fixing agent) at 50° C. for 10 minutes and then dried to obtain a printed matter.

The fiber-decomposing and coloring treatment with the treating liquid 2 and the coloring treatment of the PET fibers with the treating liquid 3 were carried out in the printed parts.

(Treating Liquid 2)

| | |
|---|---|
| DKS Finegum HEL-1 | 2% |
| MS Liquid | 5% |
| Caustic soda (fiber dissolving agent) | 10% |
| Chugai Aminol Fast Pink R (produced by Chugaikasei Co., Ltd., C.I. Acid Red 289C, quinone acidic dye) | 3% |
| Water | balance |

(Treating Liquid 3)

| | |
|---|---|
| DKS Finegum HEL-1 | 2% |
| MS Liquid | 1% |
| Malic acid | 0.1% |
| MP Red 3BSFM P (produced by Mitsui BASF Dye Co., Ltd., C.I. Disperse Red 206C, azo disperse dye) | 3% |
| Water | balance |

Comparative Example 3

A printed matter was obtained in the same manner as in Comparative Example 2 except that the fabric A was changed to a fabric E, the dye in the treating liquid 2 was changed to Kayacion Red P-4BN (treating liquid 4).

(Production of Fabric E)

A composite fabric E (thickness: 2 mm) containing 63% by weight of cotton fibers and 37% by weight of PET fibers was obtained with a warp knitted reversible (tricot half) structure by using cotton fibers (produced by Nisshin Spinning Co., Ltd.) and cation dyeable polyester fibers of a high pressure type (produced by Toray Industries, Inc., monofilament fineness: 0.7 dtex, 33 dtex/48f). The resulting fabric was formed of the cotton fibers on one side and formed mainly of the PET fibers on the other side.

The fiber-decomposing and coloring treatment with the treating liquid 4 and the coloring treatment of the PET fibers with the treating liquid 3 were carried out in the printed parts.

The patterned parts of the printed matters obtained in the aforementioned Examples and Comparative Examples were evaluated for the following items. The results are shown in the table.

(1) Clearness of Colored Patterned Part of Fiber-Decomposed Part

The clearness of the color pattern was evaluated visually according to the following standard.

A: Color inherent to dye expressed

B: Slightly dull as compared to color inherent to dye

C: Notably dull as compared to color inherent to dye (2) Pattern Expression of Colored Patterned Part of Fiber-Decomposed Part The pattern expression of the color pattern was comprehensively evaluated visually according to the following standard.

A: Expressed pattern rich in number of colors, and clear full color image expressed B: Expressed pattern with thin line part formed, but slightly poor in expression due to monochrome image C: Expressed pattern with no thin line part formed, resulting in monochrome product poor in expression (3) Light Fastness of Colored Patterned Part of Fiber-Decomposed Part The light fastness (JIS 0842) of the nylon part was comprehensively evaluated according to the following standard.

A: Light fastness practically sufficient for use (Class 4 or higher)

B: Slightly decreased in fastness with no particular problem (Class 3 or higher and lower than Class 4)

C: Clearly decreased in fastness resulting in practical problem (lower than Class 2)

(4) Clearness of Colored Patterned Part of Non-Decomposed Fiber Part

The clearness of the color pattern was evaluated according to the following standard.

A: Color pattern clearly expressed with less influence of color of nylon part

C: Clear color pattern difficulty obtained due to influence of color of nylon part (5) Strength of Fiber-Decomposed Part The tear strength of the fiber-decomposed part was measured by the A method of JIS L1018 8.16.1 (pendulum method).

(6) Light Transmittance of Fiber-Decomposed Part

The transmittance of the fiber-decomposed part was measured with Macbeth Coloreye 3000 (produced by Gretag Macbeth AG) in a measurement wavelength range of from 360 to 740 nm at every 10 nm, and an average value of the measured values at the wavelengths was designated as an average transmittance.

TABLE 1

| | Example 1 | Example 2 | Example 3 | Example 4 | Comparative Example 1 | Comparative Example 2 | Comparative Example 3 |
|---|---|---|---|---|---|---|---|
| Clearness of Colored Patterned Part of Fiber-decomposed Part | A | A | A | A | B | B | C |
| Pattern Expression of Colored Patterned Part of Fiber-decomposed Part | A | A | A | A | B | B | C |
| Light Fastness of Colored Patterned Part of Fiber-decomposed Part | A | A | A | A | B | C | B |
| Clearness of Colored Patterned Part of Non-fiber-decomposed Part | A | A | A | A | C | A | A |
| Tear Strength of Fiber-decomposed Part | 270 N | 260 N | 350 N | 370 N | 260 N | 265 N | 220 N |
| Light Transmittance of Fiber-decomposed Part | 20 | 15 | 38 | 27 | 20 | 20 | 13 |

As shown in Table 1, such opal-finished fabrics were obtained in Examples 1 to 4 that are excellent in clearness of the colored patterned parts of the fiber-decomposed part and the non-fiber-decomposed part and in pattern expression of colored patterned part of fiber-decomposed part and have a pattern rich in stereoscopic appearance. The fabric of Examples 3 and 4 were also excellent in tear strength of the fiber-decomposed part. While not shown in the table, such an opal-finished fabric was obtained in Example 2 that has high stretchability and exhibit different stretchabilities between the fiber-decomposed part and the non-fiber-decomposed part owing to the difference in structure between the parts.

The opal-finished fabric of the invention is used for various fashionable clothing products, and in particular, is favorably used as sports clothing and underwear.

The invention claimed is:

1. An opal-finished fabric comprising two or more kinds of fibers and formed with a fiber-decomposed part of transparent appearance by removing at least one kind of the fibers and a non-decomposed fiber part, wherein the fiber-decomposed part contains mainly nylon fibers, and the non-decomposed fiber part contains mainly colored polyester fibers and non-colored nylon fibers.

2. The opal-finished fabric according to claim 1, wherein the fiber-decomposed part contains mainly colored nylon fibers.

3. The opal-finished fabric according to claim 1, wherein the non-decomposed fiber part comprises a layer containing mainly polyester fibers and a layer containing mainly nylon fibers.

4. The opal-finished fabric according to claim 1, further comprising polyurethane fibers.

5. The opal-finished fabric according to claim 4, wherein the non-decomposed fiber part comprises a layer containing mainly polyester fibers and a layer containing mainly nylon fibers and polyurethane fibers.

6. The opal-finished fabric according to claim 1, wherein the layer containing mainly polyester fibers of the non-decomposed fiber part has a pattern applied on at least a surface thereof.

7. The opal-finished fabric according to claim 2, wherein the non-decomposed fiber part comprises a layer containing mainly polyester fibers and a layer containing mainly nylon fibers.

8. The opal-finished fabric according to one of claims 1 to 4 or claim 7, wherein the fiber-decomposed part is woven with an atlas stitch structure or a two-needle stitch structure.

* * * * *